United States Patent [19]

Skenazi et al.

[11] Patent Number: 4,609,529

[45] Date of Patent: Sep. 2, 1986

[54] ZINC-BASED ALLOYS WITH IMPROVED DUCTILITY

[75] Inventors: André Skenazi, Steenokkerzeel; Dimitri Coutsouradis, Liège; André Rasquin, Saive, all of Belgium

[73] Assignee: Centre de Recherches Metallurgiques, Brussels, Belgium

[21] Appl. No.: 672,261

[22] PCT Filed: Feb. 8, 1984

[86] PCT No.: PCT/BE84/00003

§ 371 Date: Oct. 11, 1984

§ 102(e) Date: Oct. 11, 1984

[30] Foreign Application Priority Data

Feb. 11, 1983 [BE] Belgium ..... 6/47.778

[51] Int. Cl.[4] ..... C22C 18/04

[52] U.S. Cl. ..... 420/516; 420/515

[58] Field of Search ..... 420/515, 516

[56] References Cited

U.S. PATENT DOCUMENTS 1,490,696 4/1924 De Golyer ..... 420/513

FOREIGN PATENT DOCUMENTS 553873 3/1958 Canada ..... 420/515
2142685 3/1973 Fed. Rep. of Germany .
1140750 8/1957 France .
328148 4/1958 Sweden .
769485 3/1957 United Kingdom ..... 420/515

*Primary Examiner*—L. Dewayne Rutledge
*Assistant Examiner*—Robert L. McDowell
*Attorney, Agent, or Firm*—Holman & Stern

[57] ABSTRACT

The ductility and/or tensile strength of certain zinc-based alloys (25 to 40 wt. % aluminum, 0.5 to 5 wt. % copper, and up to 0.1 wt. % magnesium) are improved when various elements are added. A first series of improved alloys is comprised of boron (between 5 ppm and 0.1 wt. %), possibly along with titanium (25 ppm to 0.5 wt. %), or possibly along with zirconium and/or strontium (up to 0.1 wt. %), and titanium (up to 0.1 wt. %). A second series of improved alloys is comprised of rare earths, principally lanthanum and/or cerium, in a total amount between 5 ppm and 0.1 wt. %.

9 Claims, No Drawings

ZINC-BASED ALLOYS WITH IMPROVED DUCTILITY

CROSS REFERENCE TO RELATED APPLICATION(s)

This U.S. application stems from PCT International Application No. PCT/BE84/00003 filed Feb. 8, 1984.

BACKGROUND OF THE INVENTION

The present invention relates to zinc-based alloys with improved ductility.

The current area of application of zinc-based alloys extends to numerous industrially important applications. Particularly important are zinc alloys for gravity molding.

In the past attempts have been made to improve the properties of such zinc alloys by adding one or more elements to them, in various quantities extending down to very small quantities, with the aim of obtaining alloys suited to the broadest possible range of applications.

For example, a zinc alloy for gravity molding is known which has a tensile strength on the order of 400 MPa. This strength was attained with an alloy comprised of aluminum in the amount of about 27%, and added amounts of copper and magnesium. However, this particular alloy has low ductility as seen by the fact that its standard elongation, when cast under optimum conditions, is 4 to 8%. The same pertains to other known alloys which are comprised of aluminum in the amount of about 35%, with added amounts particularly of copper.

SUMMARY OF THE INVENTION

The object of the present invention is to provide a zinc-based alloy for gravity molding which has improved ductility, in particular which has substantially greater elongation, while at the same time retaining tensile strength at least equal to that of alloys comprised of aluminum in the amount of 27% or 35% by weight.

The composition of the inventive alloy resulted from an unexpected discovery by the Applicant, according to which it is possible to improve:

The ductility of the alloy, by adding small amounts of boron and/or rare earths; or The tensile strength of alloy, by adding small amounts of titanium, zirconium, and/or strontium; or Both the ductility and the tensile strength simultaneously, by a judicious combination of the abovementioned additions. viz., the alloy type Zn-Al-Cu-Mg-(B; or B and Ti)

DETAILED DESCRIPTION OF THE INVENTION

According to a first embodiment of the present invention, an inventive zinc alloy additionally comprising aluminum (25 to 40% by wt., of the alloy), copper (0.5 to 5%), and magnesium (up to 0.1%) has a boron content between 5 ppm and 0.1% and preferably between 0.005 and 0.050%.

The effect of boron on the elongation of an alloy of the type of this first embodiment is perceptible beginning at a boron content of about 5 ppm, and increased boron content ceases to improve the elongation when the boron content exceeds about 0.1%.

Within the scope of this invention, an improvement comprises adding titanium to the boron-containing alloy in the amount of 25 ppm to 0.5% by weight, based on the total alloy and preferably 0.005% to 0.050%.

In practice it has been found that the titanium added must reach at least the amount of 25 ppm of the total alloy in order to have a perceptible effect on the tensile strength.

Also, a titanium content above 0.5% contributes negligibly to the tensile strength. i.e., alloy type Zn-Al-Cu-Mg-(B; or B and Ti)

Further, according to the present invention it is also advantageous to combine the addition of boron and titanium in such a way as to simultaneously improve the elongation and the tensile strength of the zinc alloy.

In this connection it has been found advantageous for the boron:titanium ratio to be substantially equal to 1:5.

According to a second embodiment of the present invention, an inventive alloy is comprised of boron and in addition Zr and/or Sr in the amount (total of Zr+Sr) less than 0.1%.

The applicant has found that Zn-Al-B-Zr, Zn-Al-B-Sr, or Zn-Al-B-Zr-Sr alloys with the above-specified additions of copper and magnesium and meeting the other specified criteria display both substantially increased tensile strength and greater elongation than an alloy not comprised of zirconium or strontium.

An alloy of zinc according to this second embodiment containing 25 to 40% aluminum, 0.5 to 5% copper, and up to 0.1% magnesium, is further comprised of boron in the amount of 5 ppm to 0.1% and Zr and/or Sr preferably in the amount of 0.005% to 0.050% (i.e., total of Zr+Sr).

It was surprising that the effect of the zirconium and/or strontium on the tensile strength of the alloys is not perceptible until their content (Zr+Sr) reaches about 5 ppm. However increased content of Zr and/or Sr beyond about 0.1% yields only negligible benefits in tensile strength.

In the addition of Zr and/or Sr it has proven particularly advantageous for the ratio of boron to Zr and/or Sr, to be substantially equal to 1:5.

Also according to said second particular embodiment, it has been found advantageous to combine the addition of Zr and/or Sr with an addition of titanium in an amount not exceeding 0.1%, so as to improve the tensile strength of an inventive alloy in which these different elements may permissibly be present.

According to a second alloy type (i.e., alloy type Zn-Al-Cu-Mg(rare earths)) an inventive zinc alloy composed of 25% to 40% aluminum, 0.5 to 5% copper, and up to 0.1% magnesium, is further comprised of rare earths, preferably lanthanum and cerium, in a total amount of 5 ppm to 0.1%, preferably 0.005% to 0.050%.

The effect of the rare earths on the elongation of an alloy of this second alloy type, i.e., of the specified composition of Zn, Al, Cu, and Mg, is not perceptible until their content (total of all rare earths) reaches about 5 ppm; and increased content of rare earths ceases to have a beneficial effect on elongation beyond a content of rare earths of about 0.1%.

Within the scope of this second alloy type, the rare earths may also be added in the form of the mixture known as "misch metal", with composition as follows: (a) about 60–90% La and 6–10% Ce, with the remainder comprised of other rare earths and residual amounts of other elements in particular, Fe, Mg, Al, Si); or (b) 45–60% Ce, with the remainder comprised of other rare earths and residual amounts of other elements, in particular, Fe, Mg, Al, and/or Si.

As an example, the Table below illustrates the effect of additions according to the present invention, which additions will be described hereinafter, on the tensile strength and elongation of a zinc-based alloy containing 27% Al, 1% Cu, and 0.02% Mg.

KEY to Table: (a) Alloy; (b) Tensile strength, R (in MPa (megapascals)); (c) Elongation (in %); A=Initial alloy; B=With added boron; C=With added boron and titanium; D=With added boron and zirconium; E=-With added rear earths.

Alloy A is a known alloy. Its ductility is low, corresponding to an elongation between 4 and 8%.

| | Alloy [a] | | Tensile strength $R_r$ (MPa) [b] | Elongation [c] (%) |
|---|---|---|---|---|
| A Parts | A | Zn—27% Al—1% Cu—0.02% Mg | 400 | 4–8 |
| B Addition of boron | $B_1$ | Zn—27% Al—1% Cu—0.02% Mg + 0.010% B | 400 | 19–22 |
| | $B_2$ | Zn—27% Al—1% Cu—0.02% Mg + 0.020% B | 400 | 17–20 |
| C Addition of boron and titanium | $C_1$ | Zn—27% Al—1% Cu—0.02% Mg + 0.005% B + 0.025% Ti | 410 | 16–20 |
| | $C_2$ | Zn—27% Al—1% Cu—0.02% Mg + 0.010% B + 0.025% Ti | 400 | 15–20 |
| | $C_3$ | Zn—27% Al—1% Cu—0.02% Mg + 0.010% B + 0.050% Ti | 450 | 4–8 |
| D Addition of boron and zirconium | $D_1$ | Zn—27% Al—1% Cu—0.02 Mg + 0.005% B + 0.025% Zr | 430 | 6–10 |
| E Addition of rare earth | $E_1$ | Zn—27% Al—1% Cu—0.02% Mg + 0.05% La | 400 | 15 |
| | $E_2$ | Zn—27% Al—1% Cu—0.02% Mg + 0.05% Ce | 400 | 13 |

Alloys $B_1$ and $B_2$, corresponding to the first inventive alloy type demonstrate that boron added within the limits indicated furnishes substantial increase in the elongation, wherewith the ductility is increased without modifying the tensile strength of the alloy.

Alloys $C_1$ and $C_2$ correspond to an embodiment of said first inventive alloy type. They too have increased elongation. In addition, alloy $C_1$ has a slightly increased tensile strength; here the ratio of boron to titanium in the alloy is the preferred ratio of 1:5. While alloy $C_3$ does have a distinctly higher tensile strength, its elongation remains at the level of that of the reference alloy, despite the fact that alloy $C_3$ includes boron. This phenomenon may apparently be explained by the formation of intermetallic compounds of boron and titanium which counteract the beneficial effect of the boron on the elongation when the content of titanium is relatively high.

Alloy $D_1$, which corresponds to the second embodiment of the above-mentioned first alloy type, has a distinctly higher tensile strength than the base alloy, and also has greater elongation.

Alloys $E_1$ and $E_2$, which correspond to the second inventive alloy type, demonstrate that lanthanum or cerium added within the limits indicated furnishes a substantial increase in elongation, whereby the ductility is increased without modifying the tensile strength of the alloy.

We claim:

1. A zinc-based alloy consisting essentially of, based on the weight of the alloy 25% to 40% aluminum, 0.5% to 5% copper, 0.02 to 0.1% magnesium and boron being present in an amount of about 5 ppm to about 0.1 wt. %, the balance being zinc.

2. The alloy of claim 1 further comprising titanium in the amount of about 25 ppm to about 0.5 wt. %.

3. The alloy of claim 2 wherein the weight ratio of boron to titanium in the alloy is about 1:5.

4. The alloy of claim 1 further comprising zirconium or strontium, in an amount less than 0.1 wt. %.

5. The alloy according to claim 4 wherein zirconium or strontium is in an amount of about 0.005 to about 0.050 wt. %.

6. The alloy of claim 5 wherein the ratio of the weight of the boron to the weight of zirconium or strontium in the alloy is about 1:5.

7. The alloy of claim 6 further comprising titanium in an amount not exceeding 0.1 wt. %.

8. A zinc-based alloy consisting essentially of, based on the weight of the alloy 25% to 40% aluminum, 0.5 to 5 wt. % copper, 0.02 to 0.1 wt. % magnesium and misch metal containing rare earth elements selected from the group consisting of lanthanum and cerium, in an amount from about 5 ppm to about 0.1 wt. %, the balance being zinc.

9. The alloy of claim 8 wherein said amount of misch metal is from about 0.005 wt. % to about 0.05 wt. %.

* * * * *